US009921531B2

(12) United States Patent
Ishida

(10) Patent No.: US 9,921,531 B2
(45) Date of Patent: Mar. 20, 2018

(54) FIXING DEVICE INCLUDING HEATER, RESIN FRAME AND METAL FRAME HAVING WALL DISPOSED BETWEEN RESIN FRAME AND HEATER

(71) Applicant: Brother Kogyo Kabushiki Kaisha, Nagoya-shi, Aichi-ken (JP)

(72) Inventor: Kei Ishida, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/064,803

(22) Filed: Mar. 9, 2016

(65) Prior Publication Data

US 2016/0266529 A1 Sep. 15, 2016

(30) Foreign Application Priority Data

Mar. 9, 2015 (JP) ..... 2015-045610

(51) Int. Cl.
*G03G 15/20* (2006.01)

(52) U.S. Cl.
CPC ..... *G03G 15/2053* (2013.01); *G03G 15/2028* (2013.01); *G03G 2215/0141* (2013.01); *G03G 2215/2035* (2013.01)

(58) Field of Classification Search
CPC ..... G03G 15/2053
See application file for complete search history.

(56) References Cited

U.S. PATENT DOCUMENTS 5,525,775 A * 6/1996 Setoriyama ..... G03G 15/2064 219/216
7,769,332 B2 * 8/2010 Yamamoto ..... G03G 15/206 399/329
2005/0185994 A1 * 8/2005 Inada ..... G03G 15/2053 399/328
2009/0041515 A1 2/2009 Kim
2009/0175645 A1 * 7/2009 Seol ..... G03G 15/2039 399/69
2012/0008971 A1 1/2012 Lee et al.
2013/0209147 A1 * 8/2013 Ogawa ..... G03G 15/2028 399/329
2014/0199100 A1 * 7/2014 Seol ..... G03G 15/2053 399/329
2016/0327893 A1 * 11/2016 Kim ..... G03G 15/2085

* cited by examiner

*Primary Examiner* — Walter L Lindsay, Jr.
*Assistant Examiner* — Arlene Heredia Ocasio
(74) *Attorney, Agent, or Firm* — Banner & Witcoff, Ltd.

(57) ABSTRACT

A fixing device includes an endless belt, a heater disposed inside the endless belt and being elongated in a longitudinal direction, the heater having a first end portion in the longitudinal direction and a second end portion opposite to the first end portion in the longitudinal direction, a resin frame having a recess portion opening toward an inner side of the endless belt, and a metal frame inserted into the recess portion of the resin frame. The metal frame has a first wall having a through-hole, and a second wall extending in a direction from the first end portion of the heater toward a second end portion of the heater, the second wall being disposed between the resin frame and the heater.

15 Claims, 10 Drawing Sheets

FIXING DEVICE INCLUDING HEATER, RESIN FRAME AND METAL FRAME HAVING WALL DISPOSED BETWEEN RESIN FRAME AND HEATER

CROSS-REFERENCE TO RELATED APPLICATION

This application claims priority from Japanese Patent Application No. 2015-045610 filed on Mar. 9, 2015, the entire subject-matter of which is incorporated herein by reference.

TECHNICAL FIELD

The disclosure relates to a fixing device configured to heat-fix a developer image on a recording sheet.

BACKGROUND

In the related art, a fixing device has been known which has an endless belt, a heater disposed inside the endless belt, a stay configured to support an end portion of the heater and a resin frame configured to support the stay.

SUMMARY

One illustrative aspect of the disclosure provides a fixing device comprising: an endless belt; a heater disposed inside the endless belt and being elongated in a longitudinal direction, the heater having a first end portion in the longitudinal direction and a second end portion opposite to the first end portion in the longitudinal direction; a resin frame having a recess portion opening toward an inner side of the endless belt; a metal frame inserted into the recess portion of the resin frame, the metal frame having: a first wall having a through-hole; and a second wall extending in a direction from the first end portion of the heater toward a second end portion of the heater, the second wall being disposed between the resin frame and the heater.

According to another illustrative aspect of the disclosure provides a fixing device comprising: an endless member; a heater disposed inside the endless member and being elongated in a longitudinal direction, the heater having a first end portion in the longitudinal direction and a second end portion opposite to the first end portion in the longitudinal direction; an insulating member covering at least a portion of the first end portion of the heater; a metal member; and a resin member having a dimension less than the endless member in the longitudinal direction, at least a portion of the resin member being disposed outside the endless belt, the resin member having a support surface for supporting the metal member, the support surface being located across the metal member from the mirror, wherein the metal member has: a first wall having a support surface for supporting a first end portion of the heater, the support surface of the first wall defining an opening therein; and a second wall extending in a direction from the first end portion of the heater toward a second end portion of the heater and having a dimension less than the mirror in the longitudinal direction, the second wall being disposed between the resin member and the heater.

According to still another illustrative aspect of the disclosure provides a fixing device comprising: an endless belt; a heater disposed inside the endless belt; a ceramic member supporting a first end portion of the heater; a mirror disposed inside the endless belt; a metal plate; and a resin member supporting the metal plate, wherein the metal plate has: a first wall having an opening, through which the ceramic member is inserted; and a second wall extending from the first wall in a direction coming close to the mirror, and wherein the second wall is disposed between the resin member and the heater.

According to the disclosure, it is possible to suppress the resin frame from being affected (e.g., deteriorated and/or deformed) due to the radiation heat generated from the heater.

BRIEF DESCRIPTION OF THE DRAWINGS

FIG. 3 is an exploded perspective view of a nip plate and the like;

DETAILED DESCRIPTION

According to the above-described related art, since a portion of the resin frame positioned at a more inner side than the stay in a longitudinal direction of the endless belt is exposed toward the heater, the corresponding portion may be deformed by radiation heat from the heater.

Therefore, illustrative aspects of the disclosure to suppress a resin frame from being deformed due to radiation heat from a heater.

Hereinafter, illustrative embodiments of the disclosure will be described in detail with reference to the drawings. In below descriptions, the upper and lower direction of FIG. 1 indicates the upper and lower direction, and the respective directions are described on the basis of the front, which is the right in FIG. 1, the rear, which is the left in FIG. 1, the left side, which is the front side in FIG. 1, and the right side, which is the inner side in FIG. 1, unless otherwise mentioned.

Figure 1:
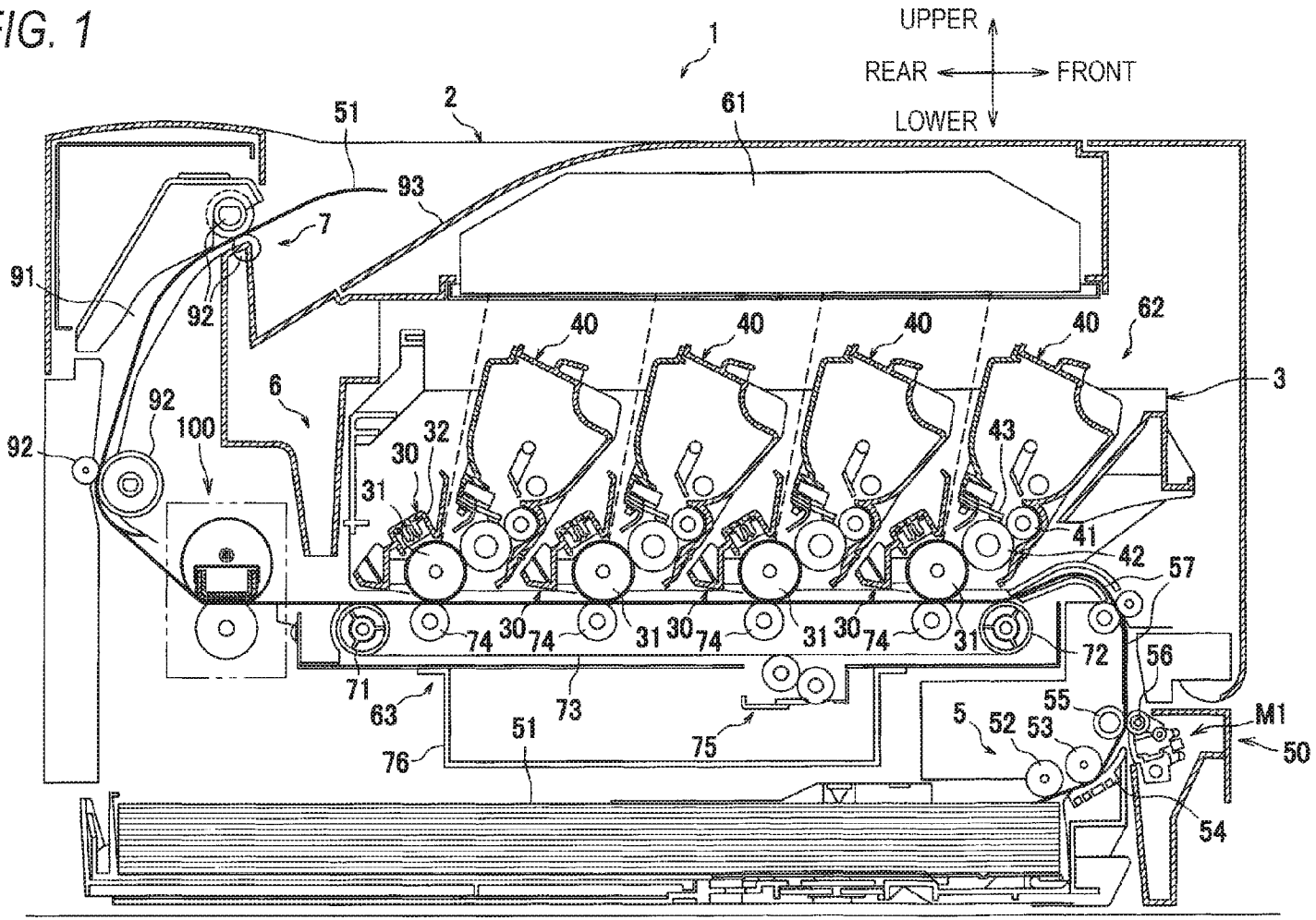
FIG. 1 is a sectional view depicting a color laser printer having a fixing device according to an illustrative embodiment of the disclosure.

As shown in FIG. 1, a color laser printer 1 mainly has, in a main body housing 2, a feeder unit 5 configured to feed a sheet 51, an image forming unit 6 configured to form an image on the fed sheet 51, and a sheet discharging unit 7 configured to discharge the sheet 51 having an image formed thereon.

The feeder unit 5 includes, at a lower portion in the main body housing 2, a sheet feeding tray 50 configured to be attached and detached to and from the main body housing 2 from the front by a slide operation and a feeder mechanism M1 configured to send sheets 51 in the sheet feeding tray 50 toward the image forming unit 6.

The feeder mechanism M1 includes a pick-up roller 52, a separation roller 53, a separation pad 54 and the like provided in the vicinity of a front end portion of the sheet feeding tray 50, and the sheets 51 in the sheet feeding tray 50 are separated one by one and conveyed upwards by the corresponding members. The sheet 51 conveyed upwards passes between a paper powder removing roller 55 and a pinch roller 56 and then a conveying path 57 including a wall member and the like (not shown), is direction-changed rearwards and is then supplied onto a conveyor belt 73, which will be described later.

The image forming unit 6 includes a scanner unit 61, a process unit 62, a transfer unit 63 and a fixing device 100.

The scanner unit 61 is provided at an upper portion of the main body housing 2, and has a laser light emitting portion, a polygon mirror, and a plurality of lenses and reflectors, which are not shown. In the scanner unit 61, laser emitted from the laser light emitting portion in correspondence of respective colors of cyan, magenta, yellow and black is scanned in the left and right direction with the polygon mirror, is passed through or reflected on the plurality of lenses and reflectors and is then irradiated to each photosensitive drum 31.

The process unit 62 is disposed below the scanner unit 61 and above the feeder unit 5, and has a photosensitive unit 3 configured to be moveable in the front and rear direction with respect to the main body housing 2. The photosensitive unit 3 has drum sub-units 30 and developing cartridges 40 mounted to the drum sub-units 30.

The drum sub-unit 30 has a photosensitive drum 31, a scorotron-type charger 32 and the like, which have been known.

The developing cartridge 40 has toner, which is an example of the developer, accommodated therein, and has also a supply roller 41, a developing roller 42, a layer thickness regulation blade 43 and the like.

The process unit 62 functions as follows. The toner in the developing cartridge 40 is supplied to the developing roller 42 by the supply roller 41. At this time, the toner is friction-charged between the supply roller 41 and the developing roller 42. The toner supplied to the developing roller 42 is rubbed by the layer thickness regulation blade 43 as the developing roller 42 is rotated, so that it is carried as a thin layer having a predetermined thickness on a surface of the developing roller 42.

In the drum sub-unit 30, the scorotron-type charger 32 uniformly charges the photosensitive drum 31 by corona discharge. The laser from the scanner unit 61 is irradiated to the charged photosensitive drum 31, so that an electrostatic latent image is formed on the photosensitive drum 31.

After that, the toner carried on the developing roller 42 is supplied to the electrostatic latent image on the photosensitive drum 31. Thereby, the electrostatic latent image on the photosensitive drum 31 becomes visible, and a toner image is carried on the surface of the photosensitive drum 31 by reversal developing, in correspondence to the toner of each color.

The transfer unit 63 has a driving roller 71, a driven roller 72, a conveyor belt 73, transfer rollers 74 and a cleaning unit 75.

The driving roller 71 and the driven roller 72 are disposed in parallel with being spaced back and forth, and the conveyor belt 73, which is an endless belt, is wound onto the rollers. The conveyor belt 73 is contacted at its outer surface to the respective photosensitive drums 31. At an inner side of the conveyor belt 73, the transfer rollers 74 configured to nip the conveyor belt 73 between the transfer rollers and the respective photosensitive drums 31 are disposed. The transfer rollers 74 are applied with a transfer bias. Upon formation of an image, the sheet 51 conveyed by the conveyor belt 73 is nipped between the photosensitive drums 31 and the transfer rollers 74 and the toner images on the photosensitive drums 31 are transferred to the sheet 51.

The cleaning unit 75 is disposed below the conveyor belt 73 and is configured to remove the toner attached to the conveyor belt 73 and to drop the removed toner to a toner storage unit 76 disposed below.

The fixing device 100 is provided at the rear of the transfer unit 63 and is configured to heat-fix the toner images transferred to the sheet 51 onto the sheet 51. The fixing device 100 will be described in detail later.

In the sheet discharging unit 7, a sheet discharge-side conveying path 91 of the sheet 51 is formed to extend upwards from an exit of the fixing device 100 and to reverse forwards. On the way of the sheet discharge-side conveying path 91, a plurality of conveying rollers 92 configured to convey the sheet 51 is disposed. On an upper surface of the main body housing 2, a sheet discharging tray 93 configured to accumulate thereon the printed sheet 51 is formed. The sheet 51 discharged from the sheet discharge-side conveying path 91 by the conveying rollers 92 is accumulated on the sheet discharging tray 93.

Figure 2:
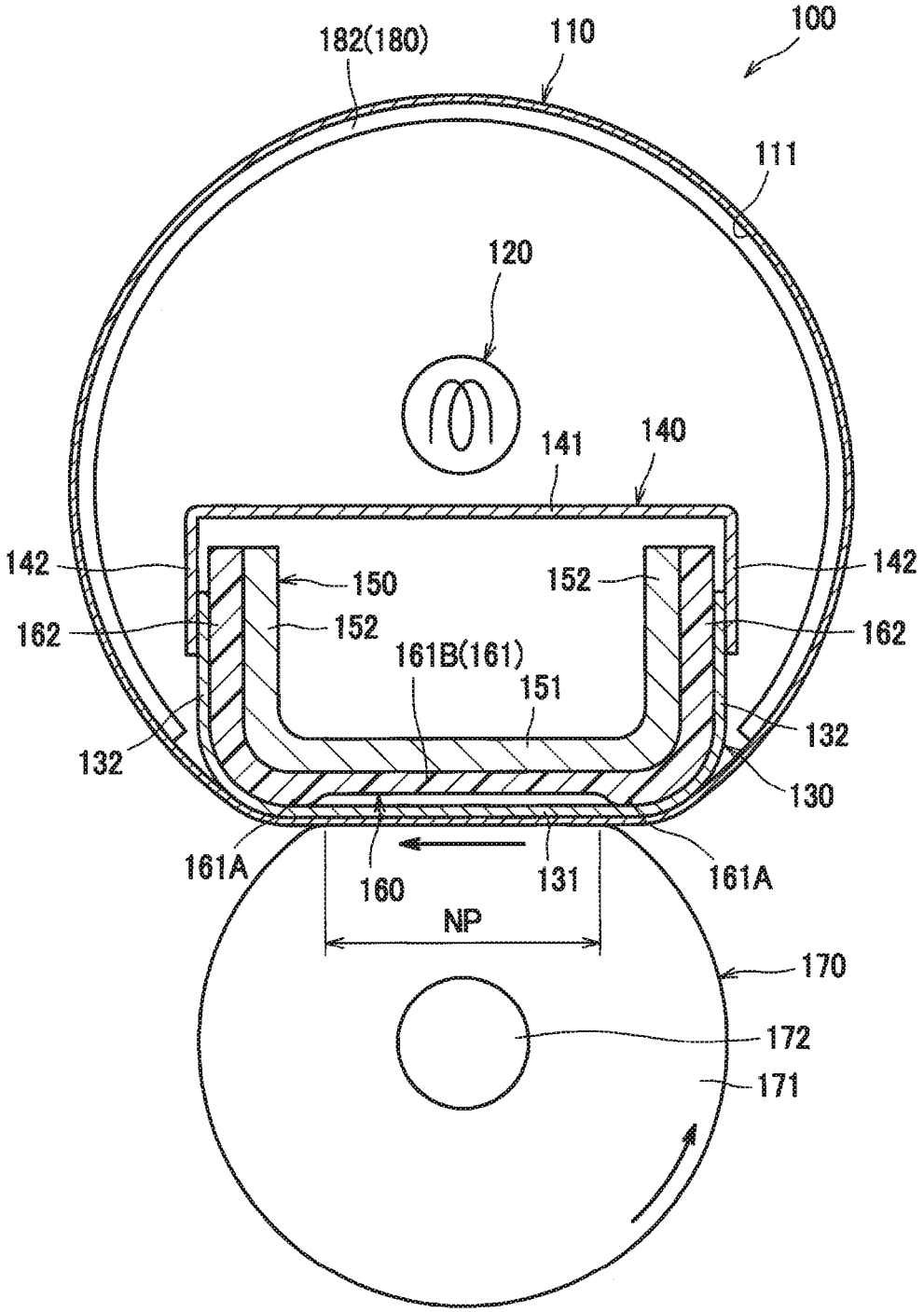
FIG. 2 is a sectional view depicting the fixing device.
Figure 3:
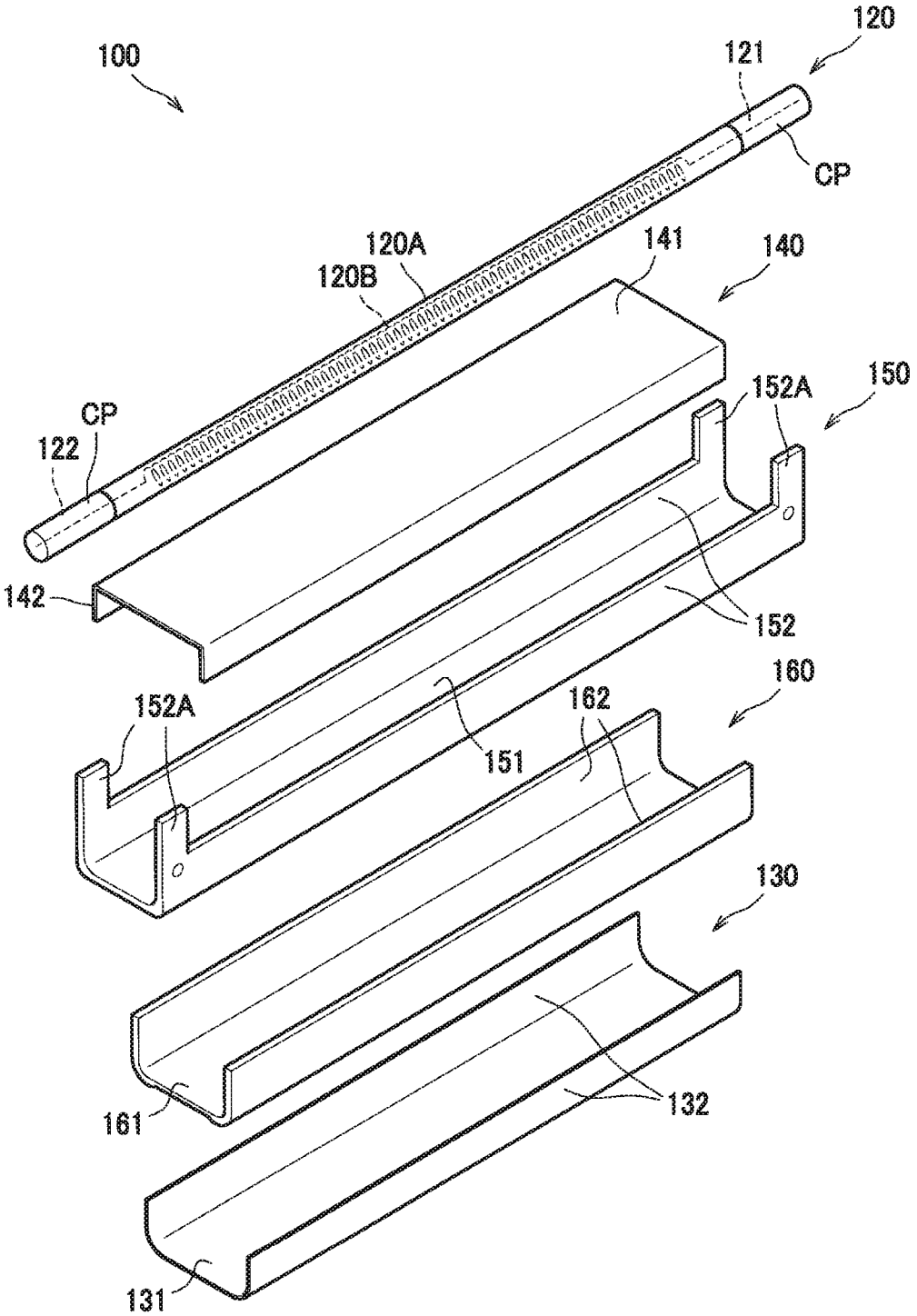

As shown in FIGS. 2 and 3, the fixing device 100 mainly has a fixing belt 110 (which is one example of an endless belt or an endless member), a halogen lamp 120, which is an example of a heater, a nip plate 130, which is an example of a nip member, a reflection plate 140 (which is one example of a reflection member or a mirror), a stay 150 and an adiabatic member 160, which are examples of the pressure-receiving member, and a pressing roller 170, which is an example of the backup member.

In below descriptions, a conveying direction (substantially front and rear direction) of the sheet 51 is simply referred to as 'conveying direction,' and an extension direction of the fixing belt 110, i.e., a longitudinal direction (substantially left and right direction) of the fixing belt 110 is simply referred to as 'longitudinal direction.' The conveying direction corresponds to a slide direction of the fixing belt 110 relative to the nip plate 130, i.e., a moving direction of the fixing belt 110 at a nip portion NP (which will be described later). The longitudinal direction of the fixing belt 110 follows a direction along which a rotating axis of the pressing roller 170 extends.

The fixing belt 110 is an endless (cylindrical) belt having heat resistance and flexibility and is configured to be rotatable, and both end portions thereof in the longitudinal direction are guided by side guides 180 (refer to FIG. 4) (which are an example of a resin frame or a resin member) (which will be described later). An inner peripheral surface 111 of the fixing belt 110 is applied with grease for reducing a frictional resistance against the nip plate 130 and the like.

The fixing belt 110 may be configured as a metal belt having a metal base material and a resin covered on an outer periphery of the base material or may have a configuration where a rubber layer is provided on a surface of metal or a non-metal protection layer is further provided on a surface of the rubber layer by fluorine coating or the like. The base material of the fixing belt 110 may be a resin such as polyimide resin or the like.

The halogen lamp 120 is a heating member configured to heat the fixing belt 110, thereby heating the toner on the sheet 51. The halogen lamp 120 is disposed at a predetermined interval from the fixing belt 110 inside the fixing belt 110. The halogen lamp 120 has a substantially cylindrical glass tube 120A extending in the longitudinal direction and a heat generation portion 120B disposed in the glass tube 120A and formed by spirally winding a filament. In addition, the halogen lamp 120 has a first end portion 121 in the longitudinal direction and a second end portion 122 opposite to the first end portion 121 in the longitudinal direction, and the end portions 121, 122 are respectively covered with a ceramic cap CP.

The nip plate 130 is disposed below the halogen lamp 120, and is in contact with the inner peripheral surface 111 of the fixing belt 110. The nip plate 130 includes a metal plate, and is formed by bending the metal plate into a substantial U shape, as viewed from a section. The metal plate may be an aluminum plate or a SUS plate.

More specifically, the nip plate 130 mainly has a base portion 131 extending in the conveying direction and sidewall portions 132 extending from each end portion of the base portion 131 in the conveying direction toward a direction getting away from the pressing roller 170, on a section orthogonal to the longitudinal direction. Herein, the direction getting away from the pressing roller 170 indicates a direction intersecting with the conveying direction of the recording sheet at the nip portion NP and getting away from the pressing roller 170.

The base portion 131 has a rectangular plain plate shape long in the longitudinal direction, and a lower surface thereof is in contact with the inner peripheral surface 111 of the fixing belt 110.

The sidewall portion 132 has a rectangular plain plate shape long in the longitudinal direction.

The reflection plate 140 is a member configured to reflect radiation heat (light) from the halogen lamp 120 toward the inner peripheral surface 111 of the fixing belt 110 and to directly irradiate the same to the inner peripheral surface 111 and being long in the longitudinal direction, and is disposed between the halogen lamp 120 and the nip plate 130 (specifically, the base portion 131) inside the fixing belt 110. In other words, the reflection plate 140 is disposed below the halogen lamp 120, and is configured to reflect the radiation heat from the halogen lamp 120 upwards, i.e., in a direction getting away from the nip plate 130. That is, the reflection plate 140 does not exist between a reflection surface of the reflection plate 140 and the fixing belt 110.

The reflection plate 140 includes a metal plate, and is formed by bending the metal plate into a substantial U shape, as viewed from a section. The metal plate may be an aluminum plate or a SUS plate.

More specifically, the reflection plate 140 mainly has a base portion 141 extending in the conveying direction and sidewall portions 142 extending from each end portion of the base portion 141 in the conveying direction toward a direction facing toward the pressing roller 170, on a section orthogonal to the longitudinal direction. Each sidewall portion 142 is configured to overlap with each sidewall portion 132 of the nip plate 130 from an outer side in the conveying direction, i.e., from the fixing belt 110-side, and is disposed close to each sidewall portion 132.

The stay 150 is a metal frame for securing stiffness of the nip plate 130, is disposed at an opposite side to the halogen lamp 120 relative to the reflection plate 140, and is configured to support the nip plate 130 via the adiabatic member 160. In other words, the stay 150 and the adiabatic member 160 are disposed at the halogen lamp 120-side with respect to the nip plate 130. The stay 150 is formed by bending metal having relatively high stiffness, for example, a steel plate into a substantial U shape, as viewed from a section.

More specifically, the stay 150 mainly has a base portion 151 extending in the conveying direction and sidewall portions 152 extending from each end portion of the base portion 151 in the conveying direction toward the direction getting away from the pressing roller 170, on a section orthogonal to the longitudinal direction. The stay 150 is longer than the nip plate 130, the reflection plate 140 and the adiabatic member 160 in the longitudinal direction, and both end portions thereof are fixed to the side guides 180 (refer to FIG. 4). A fixation structure between the stay 150 and the side guide 180 will be described in detail later.

Both end portions of upper surfaces of the sidewall portions 152 in the longitudinal direction are formed with protrusions 152A protruding upwards so as to receive forces from the side guides 180. A relation of the protrusions 152A and the side guide 180 will be described in detail later.

The adiabatic member 160 is a resin member for suppressing the heat from being transferred from the nip plate 130 to the stay 150, is disposed between the nip plate 130 and the stay 150, is configured to follow the corresponding members and has a substantial U shape, as viewed from a section. More specifically, the adiabatic member 160 mainly has a base portion 161 extending in the conveying direction and sidewall portions 162 extending from each end portion of the base portion 161 in the conveying direction toward the direction getting away from the pressing roller, on a section orthogonal to the longitudinal direction. The adiabatic member 160 is made of LCP (Liquid Crystal Polymer), which is a heat resistant resin, for example.

Each end portion 161A of the base portion 161 in the conveying direction is a convex portion protruding more downwards than a central portion 161B and is in contact with the nip plate 130. Thereby, an air layer is formed between the central portion 161B and the nip plate 130.

The reflection plate 140, the stay 150 and the adiabatic member 160 may be fixed to each other by any method. For example, each sidewall portion 162 of the adiabatic member 160 may be provided with a claw portion protruding outwards in the conveying direction, and the claw portion may be enabled to protrude toward an outside of the reflection plate 140 by passing the same through respective holes formed in the stay 150 and the reflection plate 140, and engaged on an outer surface of the reflection plate 140.

The pressing roller 170 is a member configured to interpose the fixing belt 110 between the pressing roller 170 and the nip plate 130 and to form the nip portion NP between the pressing roller 170 and the fixing belt 110, and is disposed below the nip plate 130. The pressing roller 170 has a cylindrical roller main body 171 and a shaft 172 inserted into the roller main body 171 and configured to be rotatable together with the roller main body 171. The roller main body 171 is configured to be elastically deformable.

The pressing roller 170 is configured to rotate as a driving force is transmitted thereto from a motor (not shown) provided in the main body housing 2. The pressing roller 170 is rotated, so that the fixing belt 110 is correspondingly rotated by a frictional force against the fixing belt 110 (or the sheet 51).

Figure 4:
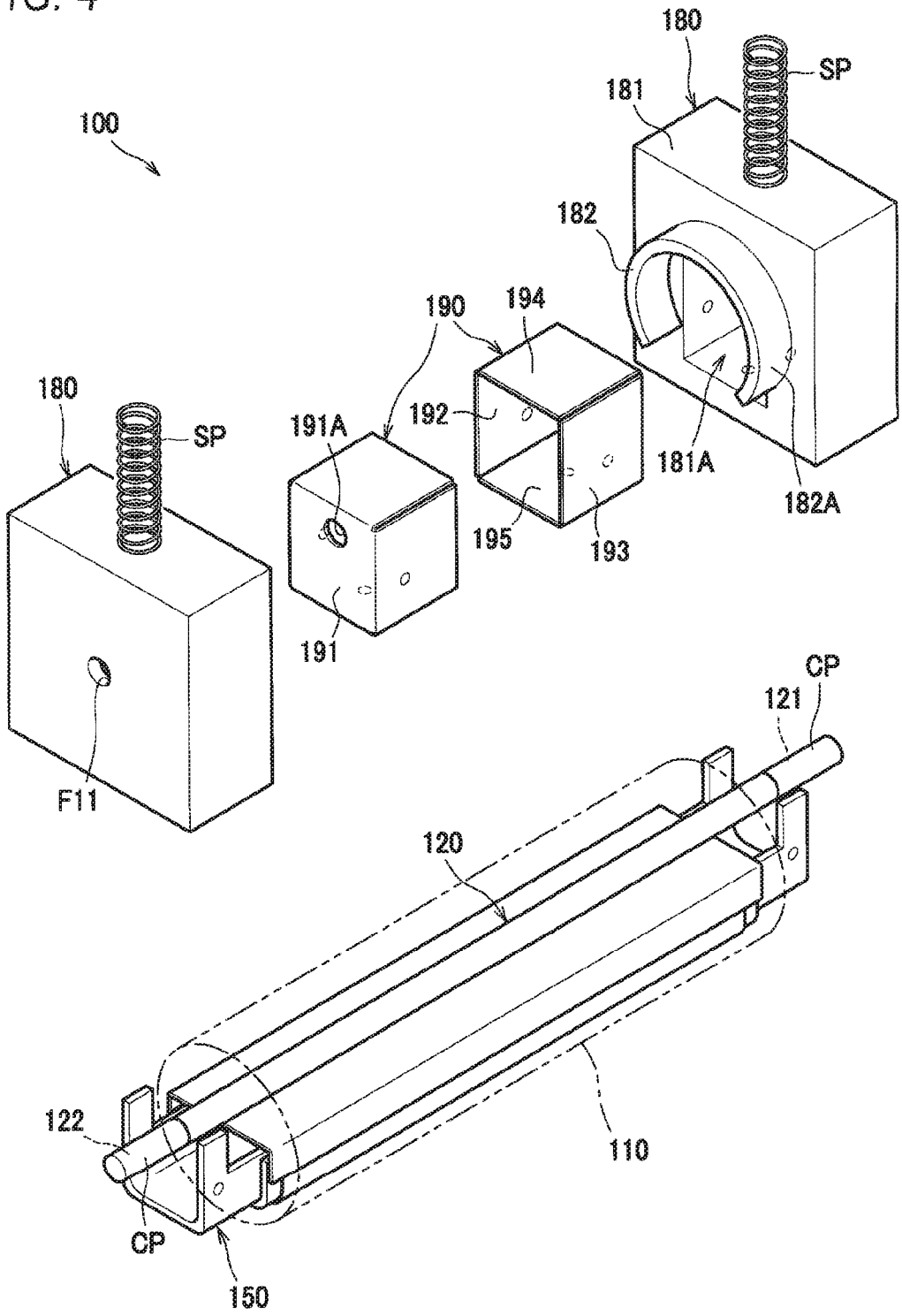
FIG. 4 is a perspective view depicting a relation of a side guide, a metal plate and a stay.

As shown in FIG. 4, the side guides 180 are members configured to guide the fixing belt 110 and are disposed to nip the fixing belt 110 therebetween in the longitudinal direction. The side guide 180 has a guide main body 181 configured to support the stay 150 via a metal plate 190 (which will be described later) (which is one example of a heat resistant frame, a metal member or a metal frame), and an inner periphery guide portion 182 configured to guide the inner peripheral surface 111 of the fixing belt 110.

The inner periphery guide portion 182 is a wall protruding from a longitudinally inner surface of the guide main body 181 toward an inner side in the longitudinal direction and having an arc shape, as viewed from a section, and an outer peripheral surface thereof is configured as a guide surface 182A configured to guide the inner peripheral surface 111 of the fixing belt 110.

Each side guide 180 is pressed downwards by a spring SP. The respective side guides 180 are pressed by the springs SP, so that a downward pressing force is applied to the stay 150 and is transmitted to the pressing roller 170 via the adiabatic member 160, the nip plate 130 and the fixing belt 110. In addition, a reactive force to the pressing force is generated from the pressing roller 170 and is received at the stay 150 via the fixing belt 110, the nip plate 130 and the adiabatic member 160.

To the contrary, a configuration where the pressing roller 170 is pressed upwards by an elastic member such as a spring and the pressing force from the pressing roller 170 is thus received at the stay 150 via the fixing belt 110, the nip plate 130 and the adiabatic member 160 is also possible.

The guide main body 181 has a support recess portion 181A opening toward an inner side in the longitudinal direction, which is an example of the recess portion. An end portion of the stay 150 and an end portion (for example, the first end portion 121) of the halogen lamp 120 are fixed in the support recess portion 181A via the metal plate 190. Specifically, the metal plate 190 is fixed to the side guide 180, and the stay 150 is fixed to the metal plate 190. Also, the halogen lamp 120 is fixed to the metal plate 190 and the side guide 180. In below descriptions, a structure of the first end portion 121-side of the halogen lamp 120 will be described in detail with reference to FIGS. 5 and 6, and descriptions of a structure of the second end portion 122-side bilaterally symmetric to the structure will be omitted.

Figure 5:
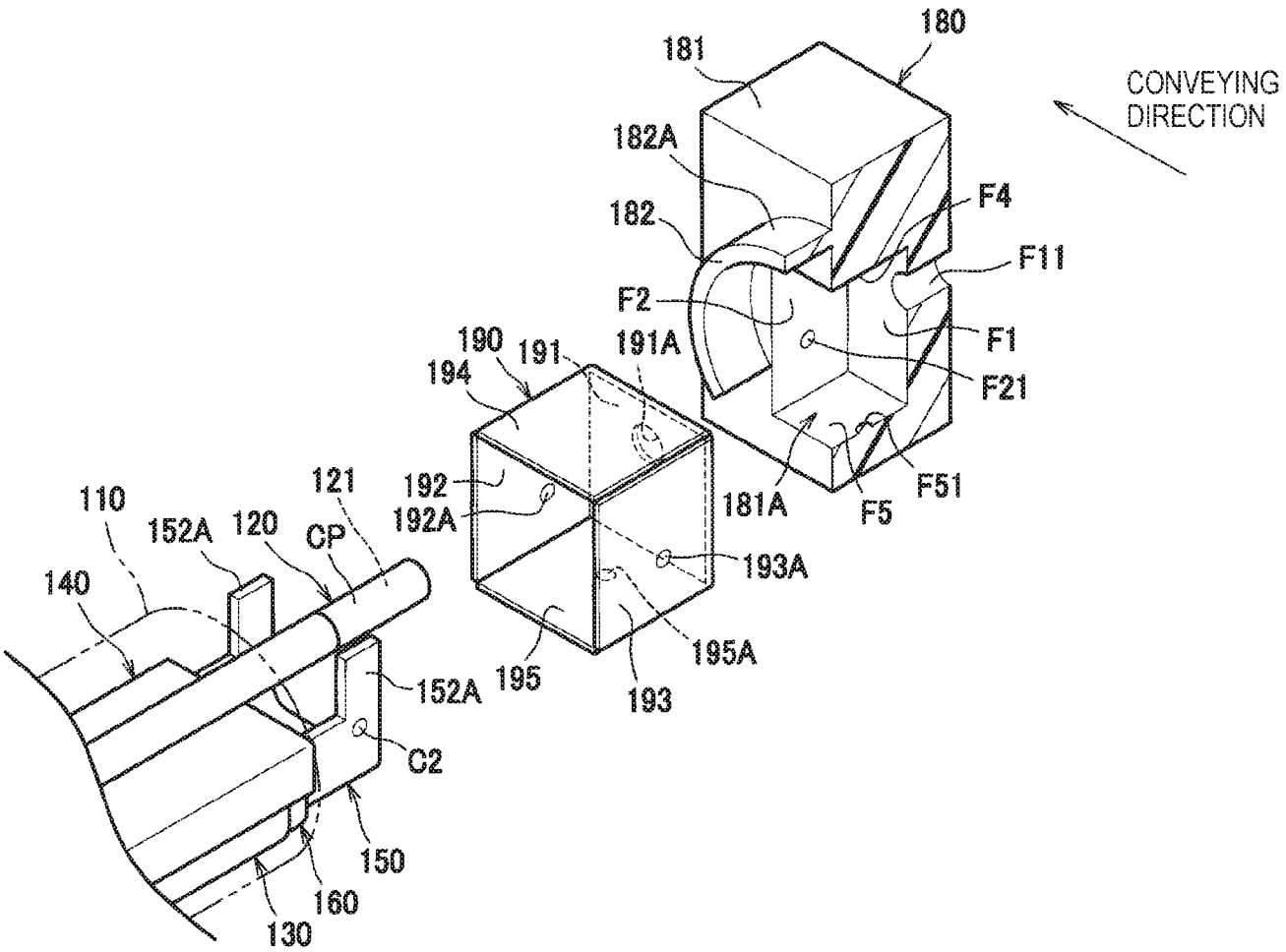
FIG. 5 is an enlarged perspective view depicting in detail the relation of the side guide, the metal plate and the stay.
Figure 6:
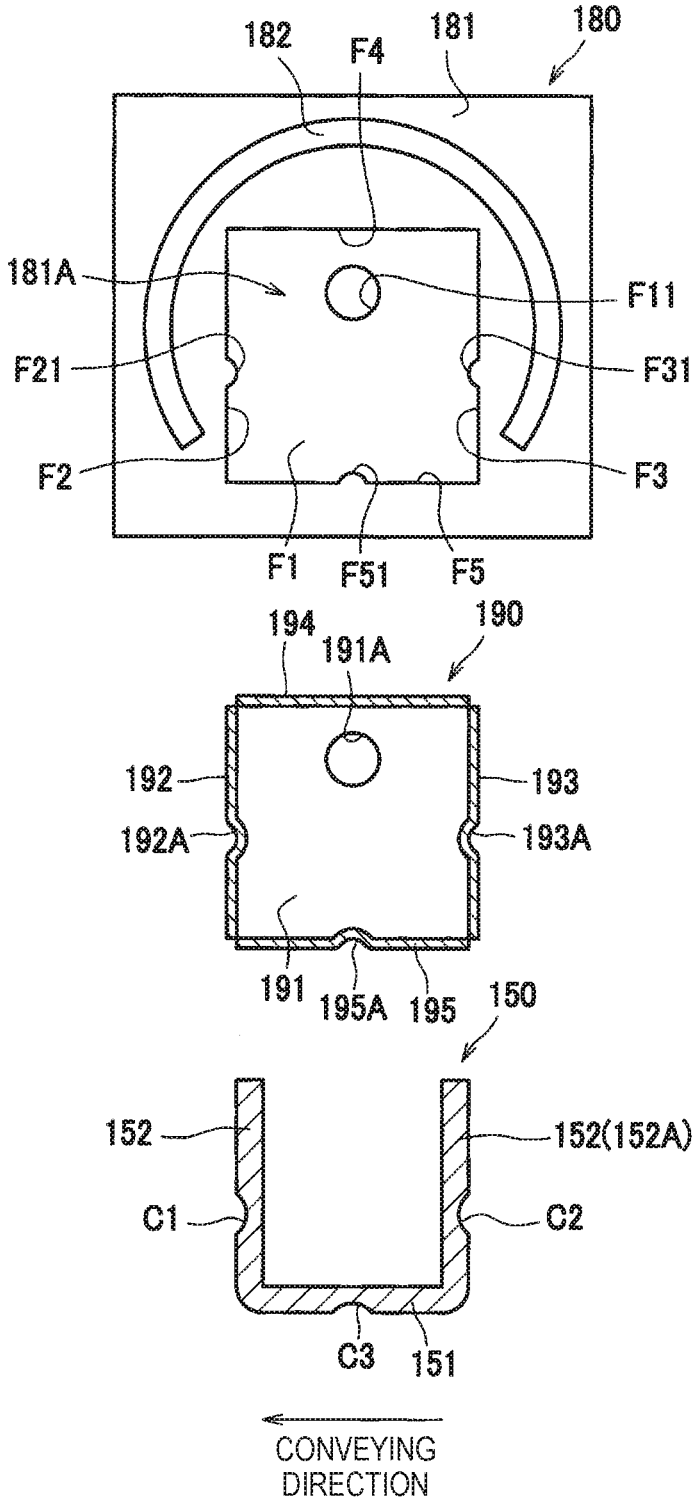
FIG. 6 depicts in detail the relation of the side guide, the metal plate and the stay.

As shown in FIGS. 5 and 6, the support recess portion 181A has a first surface F1 orthogonal to the longitudinal direction, a second surface F2 and a third surface F3 extending from each end edge of the first surface F1 in the conveying direction toward an inner side in the longitudinal direction, and a fourth surface F4 and a fifth surface F5 extending from each end edge of the first surface F1 in the upper and lower direction (an urging direction of the spring SP) toward an inner side in the longitudinal direction.

The first surface F1 is formed with a first support hole F11 configured to support the first end portion 121 of the halogen lamp 120 via the ceramic cap CP. The first support hole F11 is formed to penetrate from the first surface F1 to a longitudinally outer surface of the guide main body 181 in the longitudinal direction.

The second surface F2 and the third surface F3 face each other at an interval in the conveying direction, and the interval is substantially the same as a length of the metal plate 190 in the conveying direction. The fourth surface F4 and the fifth surface F5 face each other at an interval in the upper and lower direction, and the interval is substantially the same as a length of the metal plate 190 in the upper and lower direction. The second surface F2 and the third surface F3 are formed with projections F21, F31 protruding inwards in the conveying direction, respectively.

The fourth surface F4 is formed to connect upper ends of the first surface F1, the second surface F2 and the third surface F3, and the fifth surface F5 is formed to connect lower ends of the first surface F1, the second surface F2 and the third surface F3. The lower fifth surface F5 is formed with a projection F51 protruding upwards.

The metal plate 190 has a rectangular box shape opening inwards in the longitudinal direction, and configured to be inserted into the support recess portion 181A of the side guide 180. The metal plate 190 integrally has a bottom wall 191, which is an example of the first wall, and a downstream wall 192, an upstream wall 193, an upper wall 194 and a lower wall 195, which are examples of the second wall.

The downstream wall 192, the upstream wall 193, the upper wall 194 and the lower wall 195 are provided around the halogen lamp 120 so as to surround the halogen lamp 120. Specifically, the downstream wall 192 is disposed downstream of the halogen lamp 120 with respect to the conveying direction, and the upstream wall 193 is disposed upstream of the halogen lamp 120. The upper wall 194 is an example of the opposite wall, is disposed at an opposite side to the nip plate 130 with the halogen lamp 120 being interposed therebetween, and the lower wall 195 is disposed closer to the nip plate 130 than the halogen lamp 120.

The bottom wall 191 is a wall having a plain plate shape orthogonal to the longitudinal direction, and is formed at its appropriate portion with a second support hole 191A, which is an example of the opening for supporting the first end portion 121 of the halogen lamp 120 via the ceramic cap CP. The second support hole 191A is formed to penetrate the bottom wall 191 in the longitudinal direction, and coincides with the first support hole F11 of the side guide 180 when the metal plate 190 is inserted into the support recess portion 181A of the side guide 180.

The downstream wall 192 and the upstream wall 193 face each other at an interval in the conveying direction, and the interval is substantially the same as a length of the stay 150 in the conveying direction. The upper wall 194 and the lower wall 195 face each other at an interval in the upper and lower direction, and the interval is substantially the same as a length of an end portion of the stay 150 in the upper and lower direction, specifically, a length from an upper surface of the protrusion 152A to a lower surface of the sidewall portion 152. Thereby, the end portion of the stay 150 is fitted and fixed to the metal plate 190, so that the urging force of the spring SP is transmitted to the end portion of the stay 150, specifically, the protrusion 152A via the side guide 180 and the metal plate 190.

The downstream wall 192 and the upstream wall 193 are formed with first engaging recess portions 192A, 193A recessed inwards in the conveying direction, respectively. Also, the lower wall 195 is formed with a first engaging recess portion 195A recessed upwards.

Specifically, each of the first engaging recess portions 192A, 193A, 195A has a recessed shape, as viewed from an outer side, and a protruding shape, as viewed from an inner side. Each of the projections F21, F31, F51 of the side guide 180 is fitted to a recessed outer surface of each of the first engaging recess portions 192A, 193A, 195A from an outer side (refer to FIG. 7B). Also, a convex inner surface of each of the first engaging recess portions 192A, 193A, 195A is fitted to each of second engaging recess portions C1, C2, C3 formed at the end portion of the stay 150 from an outer side (refer to FIG. 7B). The second engaging recess portions C1, C2, C3 are respectively formed on each of the base portion 151 and respective sidewall portions 152 of the stay 150 so that they are respectively disposed at positions corresponding to the first engaging recess portions 192A, 193A, 195A.

Figure 7A:
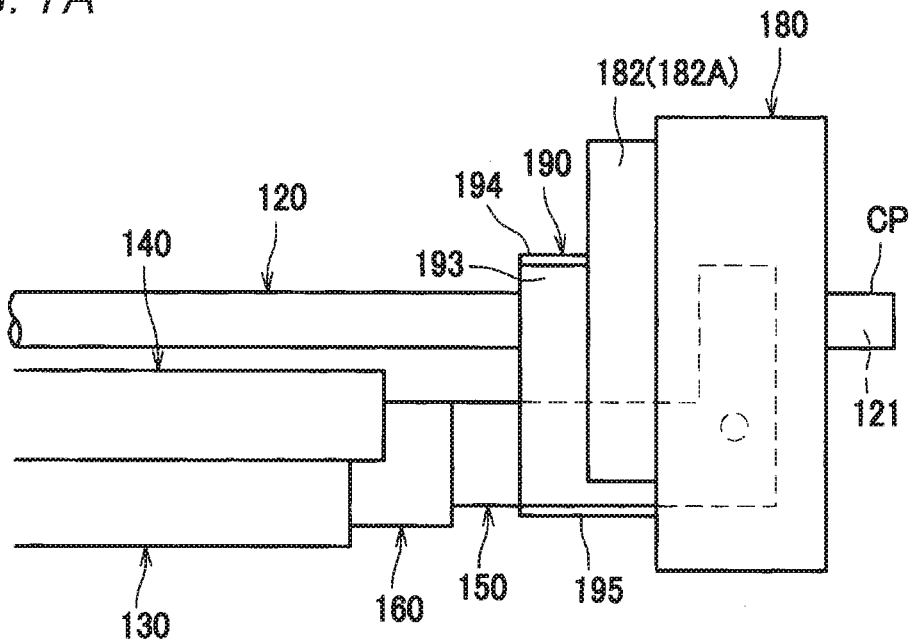
FIG. 7A depicts the side guide and the like, as viewed from a conveying direction.
Figure 7B:
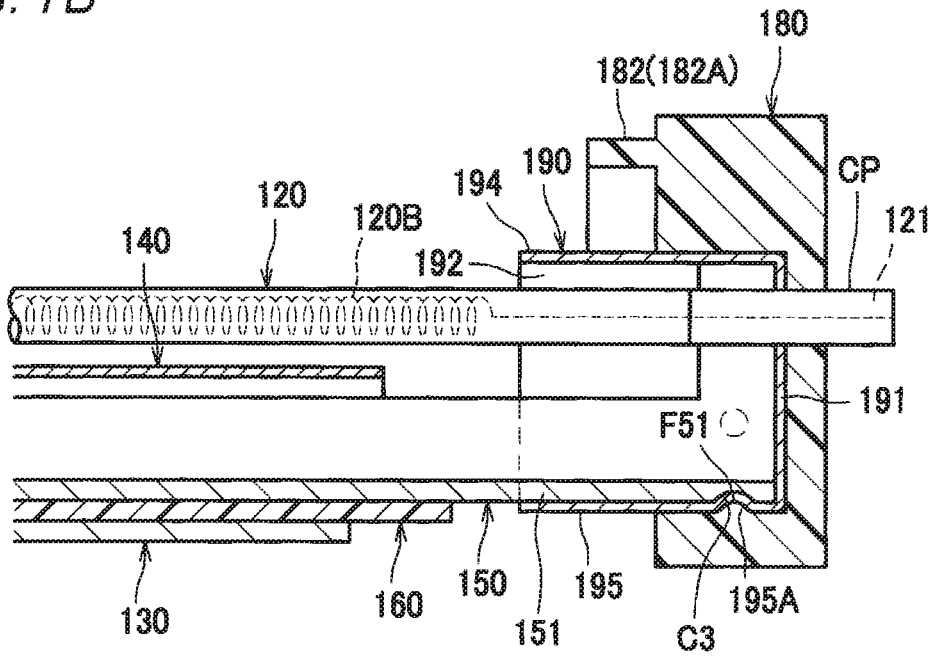
FIG. 7B is a sectional view of the side guide and the like taken along a plane orthogonal to a conveying direction.

As shown in FIG. 7B, the bottom wall 191 is disposed between the heat generation portion 120B of the halogen lamp 120 and the side guide 180 in the longitudinal direction. Herein, FIGS. 7A and 7B are a side view and a sectional view depicting a structure adjacent to the side guide 180, as viewed from an upstream thereof with respect to the conveying direction.

The downstream wall 192 is formed to extend from a downstream end edge (refer to FIG. 5) of the bottom wall 191 with respect to the conveying direction toward an inner side in the longitudinal direction, i.e., toward a center side of the fixing belt 110 in the longitudinal direction. In other words, the downstream wall 192 is formed to extend from the bottom wall 191 in a direction coming close to the second end portion 122 of the halogen lamp 120.

The downstream wall 192 is disposed between the side guide 180 and the halogen lamp 120 in the conveying direction. Specifically, the downstream wall 192 is disposed between the inner periphery guide portion 182 (the guide surface 182A) of the side guide 180 and the halogen lamp 120 in the conveying direction. In other words, the downstream wall 192 has a portion disposed between the side guide 180 and the halogen lamp 120 in the direction orthogonal to the longitudinal direction.

As shown in FIG. 7A, the upstream wall 193 is formed to extend from an upstream end edge (refer to FIG. 5) of the bottom wall 191 with respect to the conveying direction toward an inner side in the longitudinal direction. In other words, the upstream wall 193 is formed to extend from the bottom wall 191 in the direction coming close to the second end portion 122 of the halogen lamp 120.

The upstream wall 193 is disposed between the side guide 180 and the halogen lamp 120 in the conveying direction. Specifically, the upstream wall 193 is disposed between the inner periphery guide portion 182 (the guide surface 182A) of the side guide 180 and the halogen lamp 120 in the conveying direction. In other words, the upstream wall 193 has a portion disposed between the side guide 180 and the halogen lamp 120 in the direction orthogonal to the longitudinal direction.

As shown in FIG. 7B, the upper wall 194 is formed to extend from an upper end edge of the bottom wall 191 toward an inner side in the longitudinal direction. In other words, the upper wall 194 is formed to extend from the bottom wall 191 in the direction coming close to the second end portion 122 of the halogen lamp 120.

The upper wall 194 is disposed between the side guide 180 and the halogen lamp 120 in the upper and lower direction. Specifically, the upper wall 194 is disposed between the inner periphery guide portion 182 (the guide surface 182A) of the side guide 180 and the halogen lamp 120 in the upper and lower direction. In other words, the upper wall 194 has a portion disposed between the side guide 180 and the halogen lamp 120 in the direction orthogonal to the longitudinal direction.

The lower wall 195 is formed to extend from a lower end edge of the bottom wall 191 toward an inner side in the longitudinal direction. In other words, the lower wall 195 is formed to extend from the bottom wall 191 in the direction coming close to the second end portion 122 of the halogen lamp 120.

The lower wall 195 is disposed between the side guide 180 and the halogen lamp 120 in the upper and lower direction. Specifically, the lower wall 195 is disposed between the stay 150 and the side guide 180 in the upper and lower direction. In other words, the lower wall 195 has a portion disposed between the side guide 180 and the halogen lamp 120 in the direction orthogonal to the longitudinal direction.

All of the downstream wall 192, the upstream wall 193, the upper wall 194 and the lower wall 195 more protrude inwards in the longitudinal direction than the longitudinally inner surface of the inner periphery guide portion 182 of the side guide 180. An interval between the downstream wall 192, the upstream wall 193, the upper wall 194 and the lower wall 195 and the heat generation portion 120B of the halogen lamp 120 in the longitudinal direction is set to 30 mm or less. The interval may be 3 mm to 25 mm, 7 mm to 30 mm or 8 mm to 15 mm.

According to the above illustrative embodiment, following effects can be accomplished.

Since the metal downstream wall 192, upstream wall 193 and upper wall 194 are disposed between the halogen lamp 120 and the side guide 180, it is possible to shield radiation heat generated from the halogen lamp 120 from being transferred to the side guide 180 by the respective walls 192 to 194. Therefore, it is possible to suppress the side guide 180 from being deformed due to the radiation heat from the halogen lamp 120.

In particular, according to the illustrative embodiment, since the respective walls 192 to 194 are disposed between the inner periphery guide portion 182 of the side guide 180 and the halogen lamp 120, it is possible to suppress the guide surface 182A of the inner periphery guide portion 182 from being deformed due to the radiation heat from the halogen lamp 120.

Also, since the interval between the respective walls 192 to 194 and the heat generation portion 120B of the halogen lamp 120 in the longitudinal direction is set to 30 mm or less, it is possible to bring the respective walls 192 to 194 sufficiently close to the heat generation portion 120B, so that it is possible to favorably shield the radiation heat from the heat generation portion 120B by the respective walls 192 to 194.

Also, since the respective walls 192 to 194 are provided to surround the halogen lamp 120, it is possible to favorably shield the radiation heat from the heat halogen lamp 120 by the respective walls 192 to 194 around the halogen lamp 120.

Since the metal lower wall 195 is disposed with being overlapped with the metal stay 150 between the halogen lamp 120 and the side guide 180, it is possible to favorably shield the radiation heat from the halogen lamp 120 from being transferred to the lower portion of the side guide 180 by the lower wall 195 and the stay 150.

Since the metal bottom wall 191 is disposed between the heat generation portion 120B of the halogen lamp 120 and the side guide 180, it is possible to shield the radiation heat generated from the heat generation portion 120B from being transferred to the side guide 180 by the bottom wall 191. Therefore, it is possible to suppress the side guide 180 from being deformed due to the radiation heat from the heat generation portion 120B.

The disclosure is not limited to the above illustrative embodiment and can be used in a variety of forms to be exemplified below. In below descriptions, the members having the same structures as the illustrative embodiment are denoted with the same reference numerals, and the descriptions thereof are omitted.

Figure 8:
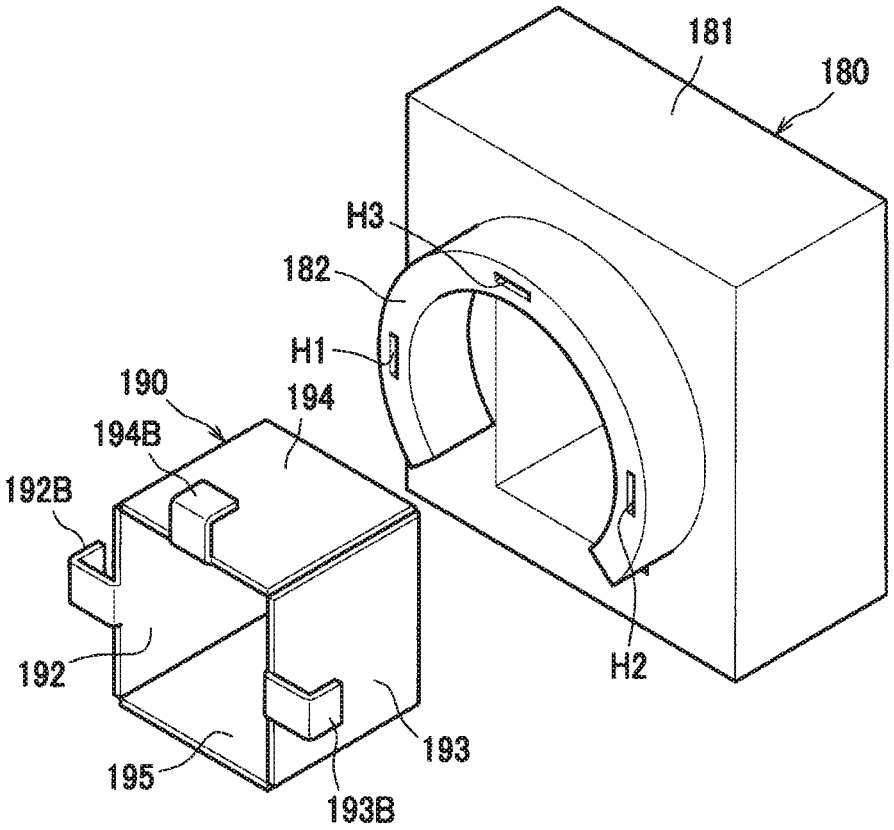
FIG. 8 is a sectional view depicting a first modified embodiment of the disclosure.

In the above illustrative embodiment, the respective projections F21, F31, F51 and the respective first engaging recess portions 192A, 193A, 195A are engaged to fix the metal plate 190 to the side guide 180. However, the disclosure is not limited thereto. For example, as shown in FIG. 8, claw portions 192B, 193B, 194B formed at the longitudinally inner end portions of the downstream wall 192, the upstream wall 193 and the upper wall 194 of the metal plate 190 may be inserted into holes H1, H2, H3 formed in a longitudinally inner end surface of the inner periphery guide portion 182 of the side guide 180 to fix the metal plate 190 to the side guide 180. Specifically, each of the claw portions 192B, 193B, 194B has an L shape extending in a direction getting away from the halogen lamp 120 and then extending toward an outer side in the longitudinal direction, as viewed from a section. Also in this case, it is possible to favorably fix the metal plate 190 to the side guide 180. In the meantime, the stay 150 may be fitted and fixed into the metal plate 190.

Figure 9:
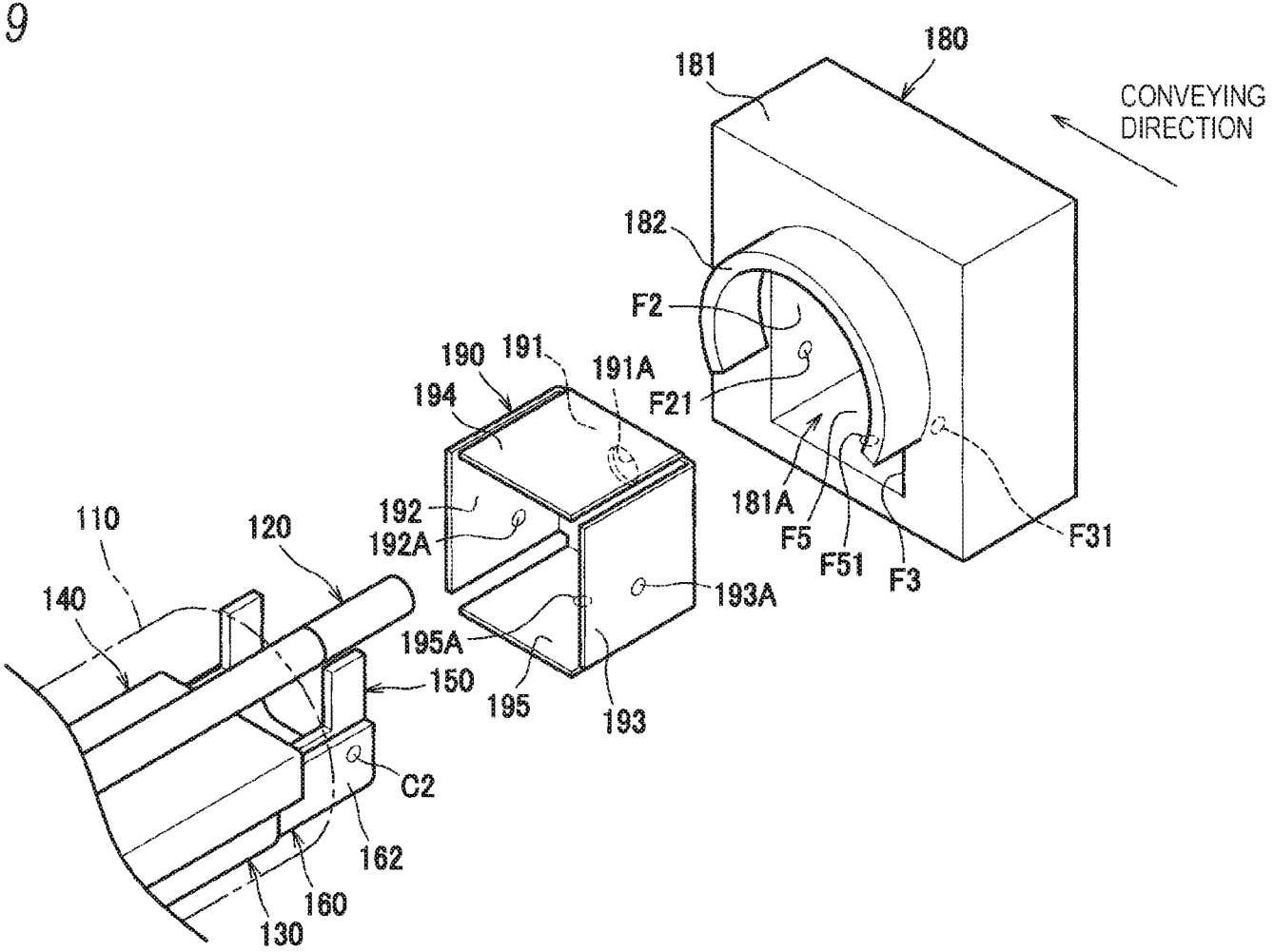
FIG. 9 is a sectional view depicting a second modified embodiment of the disclosure.

In the above illustrative embodiment, the metal plate 190 is fixed to the stay 150. However, the disclosure is not limited thereto. For example, as shown in FIG. 9, the metal plate 190 may be fixed to the adiabatic member 160. Specifically, in this configuration, the adiabatic member 160 is formed to be longer than the above illustrative embodiment so that both ends of the adiabatic member 160 are aligned with both ends of the stay 150.

The end portion of the adiabatic member 160 is formed with second engaging recess portions C1, C2, C3, which are the same as the second engaging recess portion C1, C2, C3 formed at the stay 150 in the above illustrative embodiment. Specifically, the second engaging recess portions C1 to C3 are respectively formed at the base portion 161 and respective sidewall portions 162 of the adiabatic member 160.

The interval between the downstream wall 192 and the upstream wall 193 of the metal plate 190 is greater than the above illustrative embodiment so that the downstream wall 192 and the upstream wall 193 are engaged with the respective sidewall portions 162 of the adiabatic member 160 from an outer side. Also, the lower wall 195 is disposed at a lower position than the above illustrative embodiment so that it is engaged with the lower surface of the adiabatic member 160.

In order to cope with the metal plate 190 having the greater widths in the upper and lower direction and the front and rear direction than the above illustrative embodiment, the support recess portion 181A of the side guide 180 is also formed greater. Specifically, the second surface F2, the third surface F3 and the fifth surface F5 are formed at positions corresponding to the downstream wall 192, upstream wall 193 and lower wall 195 of the metal plate 190.

Also in this structure, it is possible to favorably support the stay 150 by the side guide 180 via the adiabatic member 160 and the metal plate 190.

Figure 10:
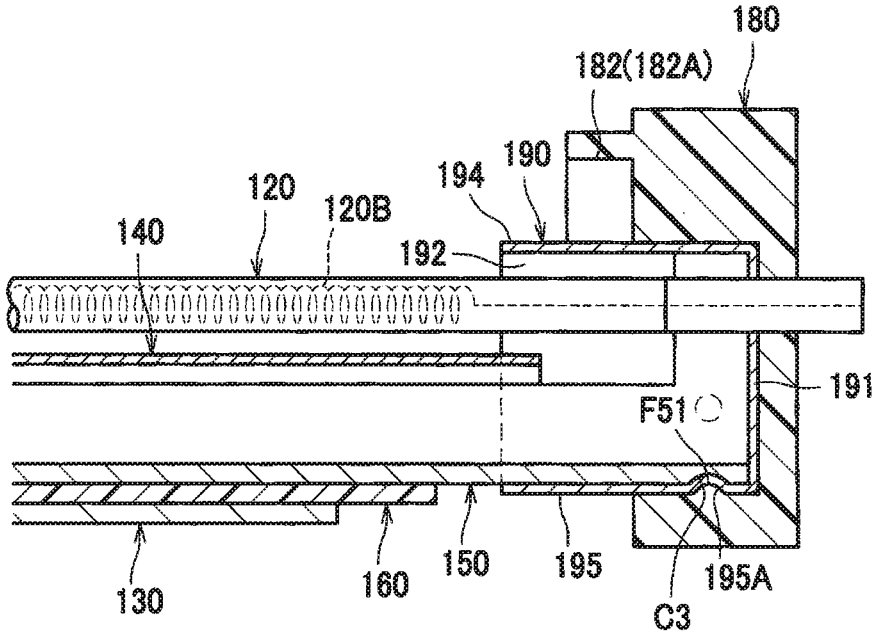
FIG. 10 is a sectional view depicting a third modified embodiment of the disclosure.

In the above illustrative embodiment, the reflection plate 140 and the respective walls 192 to 194, which are the second walls of the metal plate 190, are disposed at the interval in the longitudinal direction. However, the disclosure is not limited thereto. For example, as shown in FIG. 10, the reflection plate 140 may be formed greater in the longitudinal direction than the above illustrative embodiment so that a portion of the reflection plate 140 is located at the same position as the portions of the respective walls 192 to 194 in the longitudinal direction.

According to this configuration, it is possible to shield the radiation heat reflected on the reflection plate 140 from being transferred to the side guide 180 by the respective walls 192 to 194.

In the above illustrative embodiment, the halogen lamp 120 has been exemplified as the heater. However, the disclosure is not limited thereto. For example, the heater may be a carbon heater or the like.

In the above illustrative embodiment, the nip plate 130 having a plate shape has been exemplified as the nip member. However, the disclosure is not limited thereto. For example, a pad member or a convex member having a predetermined thickness rather than the plate shape may also be used. Also, a slide sheet for smooth rotation of the endless belt may be interposed between the nip member and the inner peripheral surface of the endless belt. In this case, the slide sheet may be attached to the nip member.

In the above illustrative embodiment, the disclosure has been applied to the color laser printer 1. However, the disclosure is not limited thereto. For example, the disclosure can also be applied to the other image forming apparatus, such as a copier, a complex machine or the like.

In the above illustrative embodiment, the pressing roller 170 has been exemplified as the backup member configured to nip the endless belt between the backup member and the nip member. However, the disclosure is not limited thereto. For example, a belt-type pressing member is also possible.

In the above illustrative embodiment, the metal frame has been exemplified as the heat resistant frame. However, the disclosure is not limited thereto. For example, a ceramic frame or a frame (liquid crystal polymer) having higher heat resistance than a resin frame (PET) is also possible.

The reflection member and the metal frame may be a member having a predetermined thickness rather than the plate shape, respectively.

The resin frame or the resin member may be formed by filling material other than the resin (e.g., glass fiber) on a resin base material.

The metal member or the metal frame may be formed by filling nonmetal filler on a metal base material or by forming a nonmetal surface layer (e.g., planting, surface coating) on a base material.

The ceramic member may be formed by filling non-ceramic filler on a ceramic base material.

The opening of the first wall may be a groove.

According to the above disclosure, since it is possible to shield radiation heat generated from the heater from being transferred to the resin frame by the metal second wall, it is possible to suppress the resin frame from being deformed due to the radiation heat from the heater.

According to the above disclosure, since it is possible to shield the radiation heat generated from the heater from being transferred to the resin frame by the second wall of the heat resistant frame, it is possible to suppress the resin frame from being deformed due to the radiation heat from the heater.

According to the above disclosure, since it is possible to shield the radiation heat generated from the heater from being transferred to the resin frame by the second wall of the heat resistant frame, it is possible to suppress the resin frame from being deformed due to the radiation heat from the heater.

According to the above disclosure, since it is possible to shield the radiation heat generated from the heater from being transferred to the guide portion of the resin frame by the second wall of the heat resistant frame, it is possible to suppress the guide portion of the resin frame from being deformed due to the radiation heat from the heater.

What is claimed is:

1. A fixing device comprising:

an endless belt, the endless belt having an inner peripheral surface defining an internal space therein;

a heater disposed inside the endless belt and being elongated in a longitudinal direction, the heater having a first end portion in the longitudinal direction and a second end portion opposite to the first end portion in the longitudinal direction;

a resin frame having:

a main body having a recess portion opening toward the internal space of the endless belt, the recess portion being disposed outside of the internal space of the endless belt and being recessed in a direction from the second end portion of the heater toward the first end portion of the heater, and a guide portion protruding from the main body in a direction from the first end portion of the heater toward the second end portion of the heater, the guide portion being configured to guide an inner peripheral surface of the endless belt; and a metal frame inserted into the recess portion of the resin frame, the metal frame having:

a first wall having a through-hole where the first end portion of the heater is inserted, the first wall being disposed inside the recess portion; and a second wall extending in a direction from the first end portion of the heater toward a second end portion of the heater, the second wall being disposed between the resin frame and the heater, the second wall being disposed to receive radiant heat from the heater, the second wall extending from outside of the internal space of the endless belt to the inside of the internal space of the endless belt.

2. The fixing device according to claim 1, wherein the second wall is disposed between the guide portion and the heater, the second wall overlapping with the guide portion when viewed from a direction perpendicular to the longitudinal direction.

3. The fixing device according to claim 2, wherein the second wall of the metal frame protrudes relative to the guide portion in the direction from the first end portion of the heater toward the second end portion of the heater.

4. The fixing device according to claim 1, further comprising:

a reflection member elongated in the longitudinal direction and configured to reflect radiation heat from the heater toward the endless belt, wherein a portion of the second wall is overlapped with a portion of the reflection member when viewed from a direction perpendicular to the longitudinal direction.

5. The fixing device according to claim 4, wherein a portion of the second wall overlaps with the reflection member, and wherein the second wall of the metal frame does not contact the reflection member.

6. The fixing device according to claim 1, further comprising:

a nip member capable of being in contact with the inner peripheral surface of the endless belt;

a backup member configured to nip the endless belt between the nip member and the backup member; and a metal stay disposed between the nip member and the heater and elongated in the longitudinal direction, wherein the metal frame is fixed to the metal stay.

7. The fixing device according to claim 1, wherein the heater has a glass tube defining an axis of the glass tube.

8. The fixing device according to claim 7, wherein the direction from the first end portion of the heater toward a second end portion of the heater is parallel to the glass tube.

9. The fixing device according to claim 7, wherein the second wall of the metal frame overlaps the guide portion of the resin frame when viewed from a direction perpendicular to the axis of the glass tube.

10. The fixing device according to claim 7, wherein the heater includes a halogen lamp.

11. The fixing device according to claim 7, further comprising:

an insulating member covering an end portion of the heater, the insulating member being inserted inside the through-hole of the metal frame.

12. The fixing device according to claim 1, further comprising:

a ceramic member covering an end portion of the heater, the ceramic member being inserted inside the through-hole of the metal frame.

13. The fixing device according to claim 12, wherein the ceramic member is a ceramic cap.

14. The fixing device according to claim 1, further comprising a backup member, the backup member and the endless belt being configured to form a nip portion therebetween where a sheet is to be conveyed in a conveying direction, wherein the metal frame further includes:

an upstream wall extending in a direction from the first end portion of the heater toward a second end portion of the heater, the upstream wall being disposed between the resin frame and the heater, the upstream wall being disposed to receive radiant heat from the heater, and a downstream wall extending in a direction from the first end portion of the heater toward a second end portion of the heater, the downstream wall being disposed between the resin frame and the heater, the downstream wall being disposed to receive radiant heat from the heater, the downstream wall being disposed downstream in the conveying direction relative to the upstream wall and being spaced apart from the upstream wall in the conveying direction.

15. The fixing device according to claim 14, wherein the recess portion has an engaging protrusion, and wherein the second wall has an engaging recess portion engaging with the engaging protrusion, the engaging recess portion being disposed outside of the internal space of the endless belt.

* * * * *